United States Patent [19]

U'Ren

[11] 4,334,393

[45] Jun. 15, 1982

[54] EARTH-SHELTERED STRUCTURE

[75] Inventor: Kenneth R. U'Ren, Morton, Minn.

[73] Assignee: Everstrong Marketing, Inc., Redwood Falls, Minn.

[21] Appl. No.: 126,657

[22] Filed: Mar. 3, 1980

[51] Int. Cl.[3] ..... E02D 27/00

[52] U.S. Cl. ..... 52/169.6; 52/169.14; 52/93

[58] Field of Search ..... 52/293, 93, 92, 169.6, 52/169.14, 169.1; 405/288

[56] References Cited

U.S. PATENT DOCUMENTS

| | | | |
|---|---|---|---|
| 645,997 | 3/1900 | Carry | 52/169.1 |
| 1,158,154 | 10/1915 | Albree . | |
| 1,378,448 | 5/1921 | Gilbert | 52/93 |
| 1,796,642 | 6/1957 | Woodworth | 52/93 |
| 1,946,720 | 2/1934 | Stearns | 405/288 |
| 2,050,798 | 8/1936 | Kothe | 52/169.14 |
| 2,712,863 | 7/1955 | Busch . | |
| 2,878,665 | 3/1959 | Crabbe | 52/169.6 |
| 3,807,116 | 4/1974 | Flynn . | |
| 4,179,857 | 12/1979 | Danford | 52/73 |

FOREIGN PATENT DOCUMENTS

| | | | |
|---|---|---|---|
| 1173349 | 2/1959 | France | 52/93 |

OTHER PUBLICATIONS

*DFPA Plywood Family Fallout Shelters.*

*Family Shelter Designs,* Jan. 1962 Dep. of Defense Office of Civil Defense, pp. 15–18, 23–26.

*All-Weather Wood Foundation System,* ©1978 American Plywood Association.

*Earthen Home Construction,* Bulletin 18 Mar. 1962, Texas Transportation Institute, pp. 20, 21.

*Earth for Homes,* Mar. 1955 United States Operations Missions, pp. 25 and 18.

*Underground Housing is Coming on Strong,* of David Hanpert Better Homes and Gardens, Sep. 1979, pp. 97, 98–105.

Design of Plywood Stressed-Skin Panels PDS Supplement #3.

The Earthen Covered Home Folks by American Solartron Corp.

*The Plen-Wood System-Jan. 1979-The American Plywood Association.*

*The All-Weather Wood Foundation System,* ©1976 by National Forest Products Association.

*Primary Examiner*—Price C. Faw, Jr.

*Assistant Examiner*—H. Raduazo

*Attorney, Agent, or Firm*—Steven G. Parmelee; James R. Haller

[57] ABSTRACT

An earth-sheltered structure having a foundation wall comprised substantially of wood. The remaining structural members that contribute towards supporting the structure are also comprised substantially of wood, including a ceiling-to-wall juncture that makes use of stud-supported notched ceiling joist members.

11 Claims, 4 Drawing Figures

Fig. 4
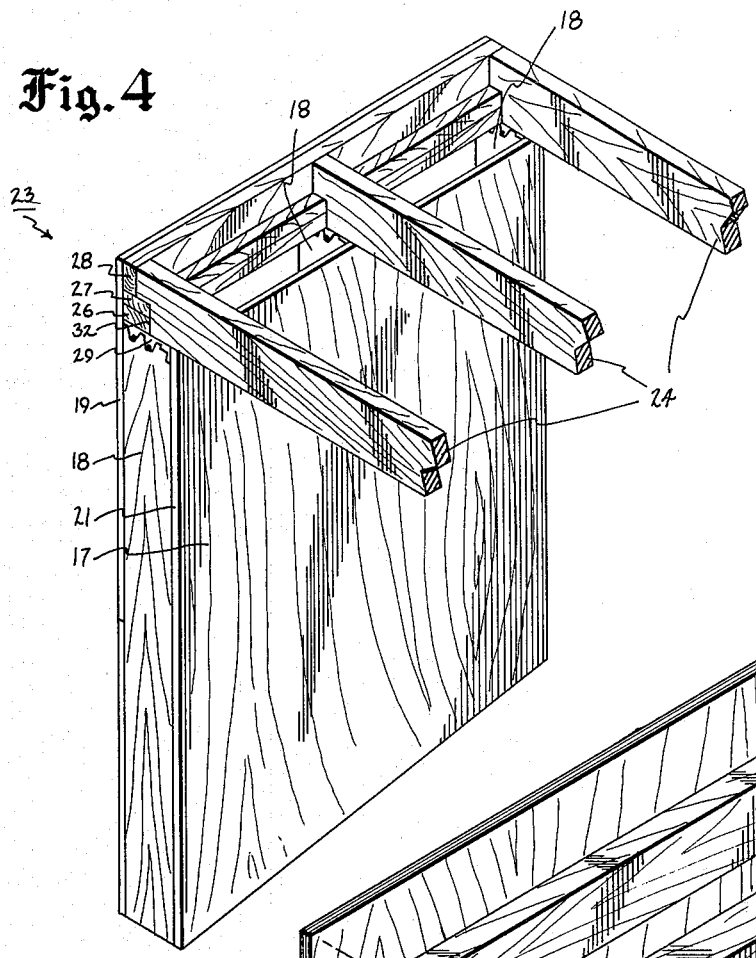
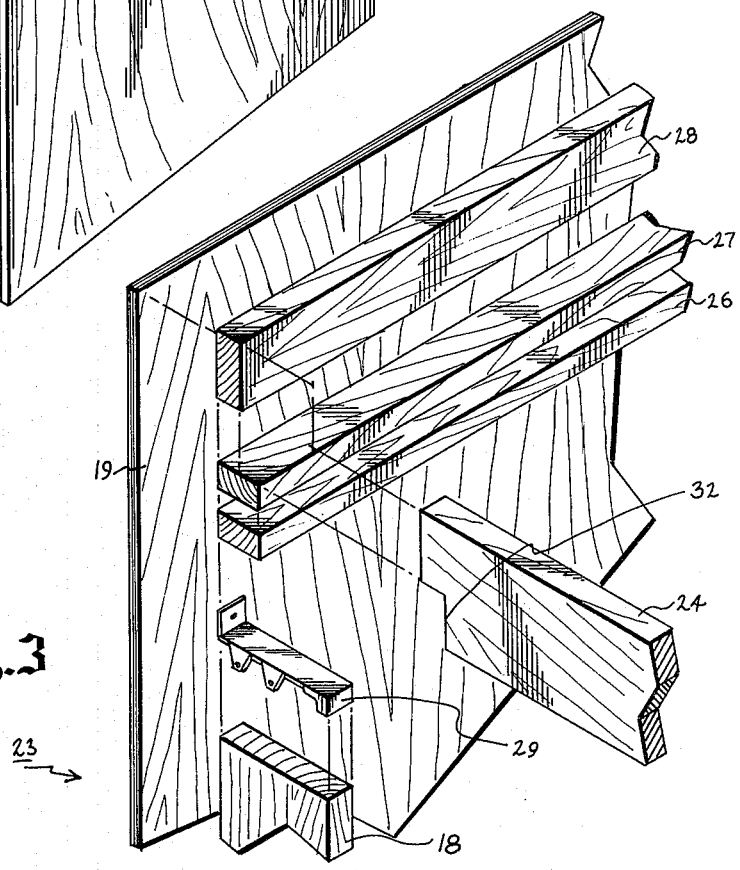
Fig. 3

EARTH-SHELTERED STRUCTURE

TECHNICAL FIELD

This invention relates generally to earth-sheltered structures.

BACKGROUND ART

Throughout his known history, man has used a variety of mediums from which to fabricate his shelter, including earth. An increasing awareness of energy usage and waste has inspired a resurge of interest in earth-sheltered structures. As used herein, "earth-sheltered" refers not only to underground housing, but also to structures built above ground that have at least the roof and one side substantially sheltered by a layer of earth.

Constructing an earth-sheltered structure requires the builder to take into consideration certain factors not usually present in ordinary construction. The layer of earth used to shelter and insulate the structure not only increases the ordinary stress that the structure must withstand, but also introduces significant stresses from directions not ordinarily encountered when building a non-earth-sheltered structure. Because of this, the builder should not simply strengthen an ordinary above-ground structure and assume that it will serve suitably as an earth-sheltered structure.

To meet these considerations, the construction industry has generally relied upon concrete foundation walls to support earth-sheltered structures. Although such foundations have proven to be structurally sound, they present other problems for the builder. Most importantly, perhaps, such foundations are relatively expensive and time-consuming to build and generally require a significant amount of on-site preparation and expertise. Concrete foundations also contribute to an undesirable humid atmosphere in the structure.

The remaining structural members that contribute towards supporting the structure in earth-sheltered structures of the prior art include other important non-wood elements as well. For instance, metal beams, metal strapping and fiberglass sheer walls have all been relied upon in various earth-sheltered structures to assist in supporting both the structure and the layer of earth. Unfortunately, such items may be difficult to obtain at times, and may otherwise necessitate inconvenience in their obtainment and installation.

There therefore exists a need for a structurally sound, low cost earth-sheltered structure that may be easily and quickly erected with a minimum of on-site expertise.

SUMMARY OF THE INVENTION

The instant invention meets these needs by providing an earth-sheltered structure that makes use of a wood foundation wall. The invention also provides for a unique ceiling-to-wall juncture made substantially of wooden members that promote stability and cooperates with the forces exerted by the sheltering earth to aid in stabilizing the structure. Significantly, the supporting members of the structure disclosed herein are made entirely of wood, with the exception of fasten-agents utilized to attach the various members together.

Wood foundations, while not necessarily unique in the construction art, have not been previously used in earth-sheltered structures. The construction industry has not believed that such a foundation would provide suitable support when used in such an application. The applicant has determined that contra this belief, such foundations can meet and exceed all the requirements of an earth-sheltered structure.

The ceiling-to-wall juncture also contributes to the ability of this structure to withstand the increased stress typically found in an earth-sheltered structure. This juncture includes a notched ceiling joist that fits snugly about one or more top plate members located atop the exterior walls. The notched fitting forces the supporting members to cooperate such that the construction materials themselves support the structure, and not just the fastener items that might ordinarily be relied upon in an ordinary structure.

BRIEF DESCRIPTION OF DRAWINGS

These and other advantages of the disclosed invention will be made more clear in the following detailed description of the best mode for carrying out the invention, and particularly when reviewed in conjunction with the appended drawings, wherein:

FIG. 3 is an enlarged perspective exploded view of the ceiling-to-wall juncture; and FIG. 4 is a perspective view of the ceiling-to-wall juncture.

BEST MODE FOR CARRYING OUT THE INVENTION

Although the invention disclosed herein could be applied in a structure built entirely undergound, the applicant intends generally to apply the invention to structures built substantially above ground and that are sheltered in a layer of dirt covering substantially three sides and the roof. Generally, the fourth side facing south will be left substantially unobstructed by dirt such that entrances, windows, building facades and the like may be used.

Figure 1:
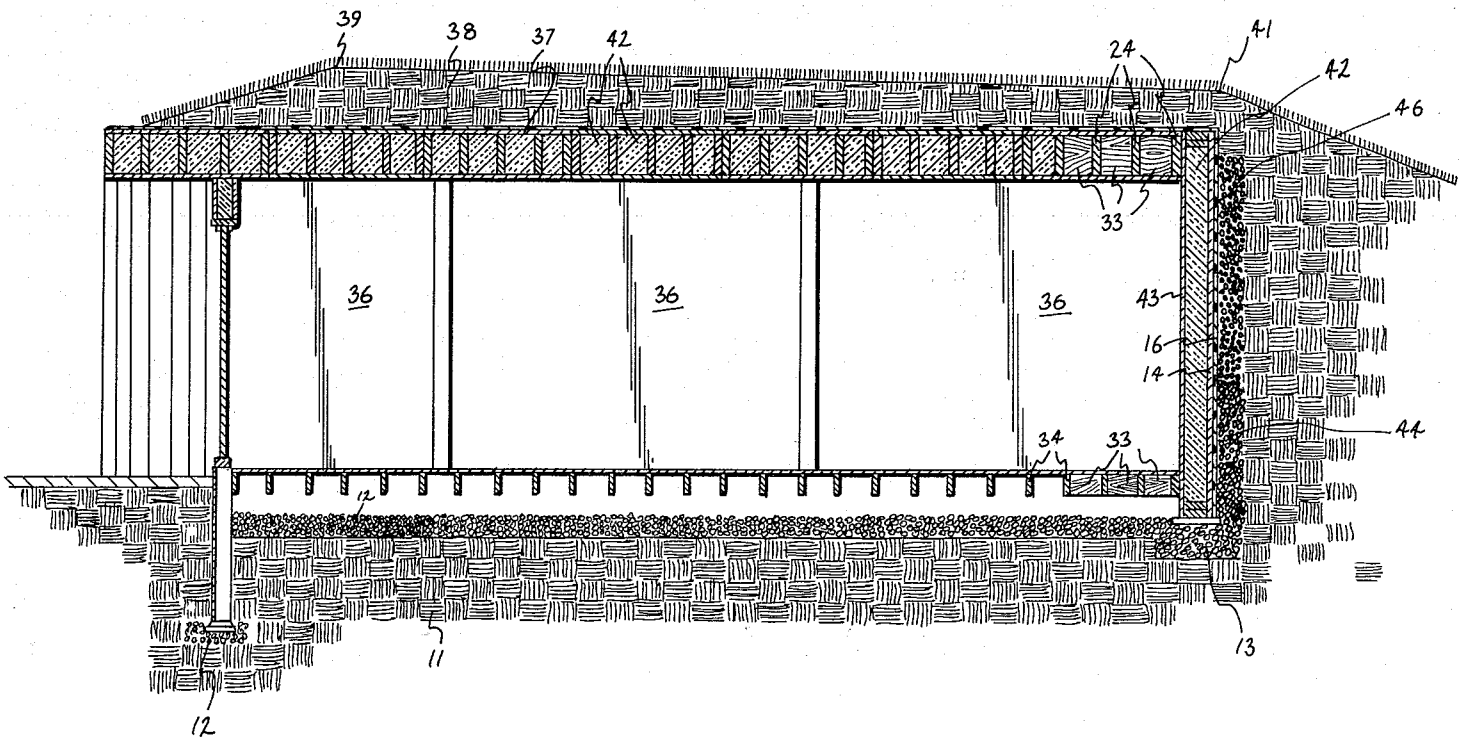
FIG. 1 is a side elevational sectional view of the structural framework for an earth-sheltered structure built in accordance with the invention.

With reference to FIG. 1, in building a structure in accordance with the invention, the applicant first grades the construction site (11) by any manner and according to such standards as are well-known in the art. The applicant then covers the construction site (11) with a layer of gravel or crushed rock (12) approximately 4 to 8 inches thick. (As used herein, gravel means gravel having little or no fines.) Additional support may be gained by providing an additional thickness of rock approximately 12 inches thick by 24 inches wide (assuming firm soil) or a concrete plate at those plates where the structure will be directly supported, such as where a wall will be placed (13). This gravel footing will distribute the weight of the structure and of the sheltering earth more evenly over the supporting construction site (11).

A foundation wall (14) constructed substantially of wood will then be built on top of the gravel footing (12). In general, this wooden foundation wall (14) may be constructed in accordance with usual industry guidelines and standards for wooden foundations as used in non-earth-sheltered structures, with the notable exception that structural members will generally be of larger dimensions as required to appropriately support the structure and the sheltering earth.

Since such a foundation (14) will be subjected to environmental forces generally considered detrimental to wood, the materials should be treated to resist such effects. Lumber appropriately treated with chromated copper arsenate works particularly well in this regard. Lumber so treated is clean, ordorless and safe to handle. It will also resist fungi, mold, rot, and various insects such as termites and carpenter ants, and the protective chemical will not leech out of the wood. Also, plastic sheeting (16) may be secured around the foundation as shown to provide a water barrier and to further protect the wood.

Figure 2:
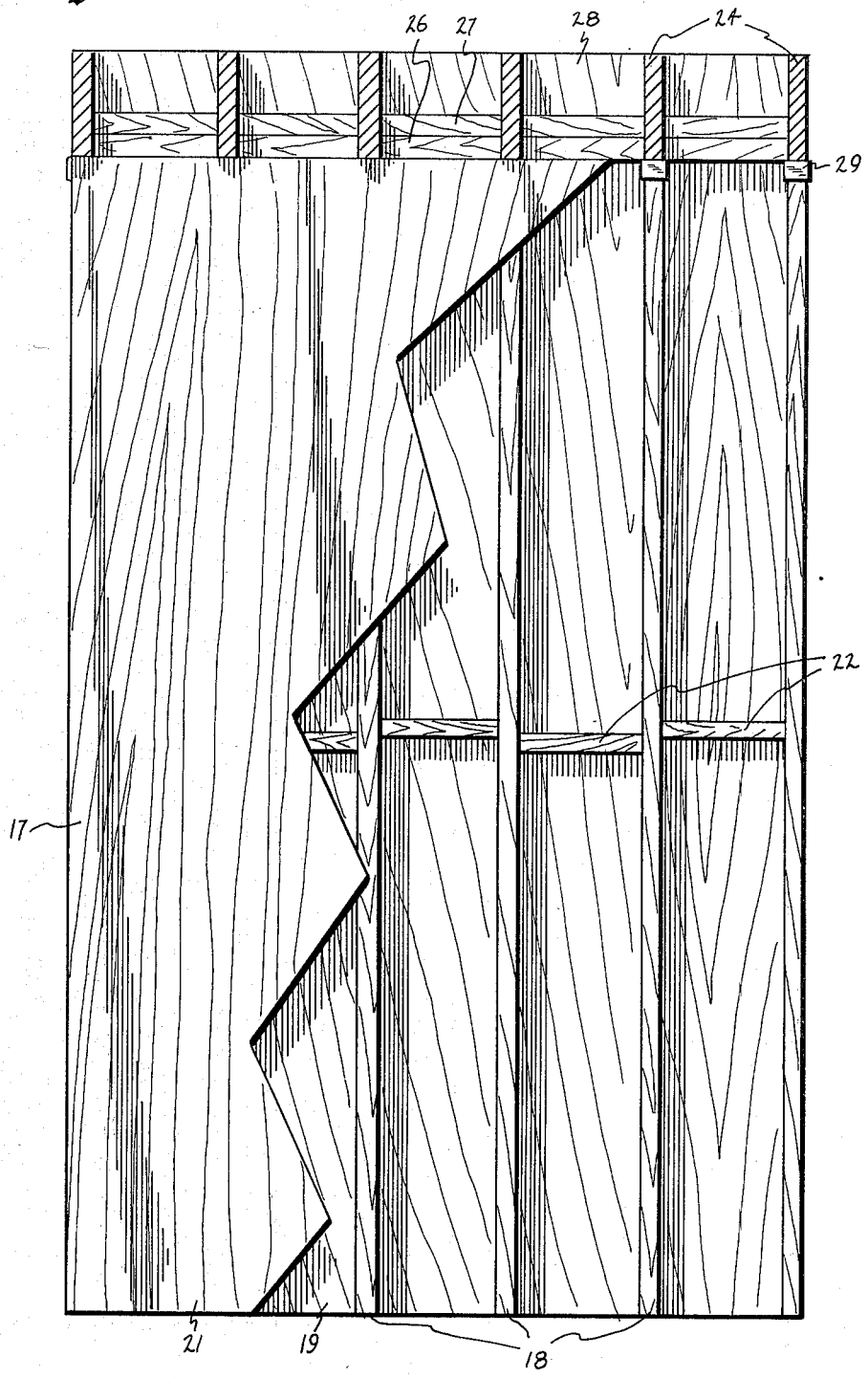
FIG. 2 is a front elevational partially cut-away view of an exterior wall segment.

Referring now to FIG. 2, the walls (17) may be generally built in accordance with usual industry guidelines and practices, with a few exceptions. The walls (17) are formed about a typical skeleton of upright studs (18) and have structural plywood secured to their exterior surface (19). Either plywood sheeting or sheet rock or some other suitable covering may be secured to the studs (18) to provide an interior surface (21). Horizontal blocking (22) may also be located approximately half-way up the wall (17), as depicted. The blocking members (22) may be slightly offset with respect to one another to facilitate fastening the member (22) to the studs (18). The exterior plywood (19) should be configured such that the horizontal joint between sheets will substantially buttress the blocking members, to ensure additional strength.

As depicted in FIG. 3, each ceiling-to-wall juncture (23) includes a wall stud (18), a ceiling joist member (24), two top plate members (26 and 27), a rim joist member (28), a purlin clip (29) and a sheet of structural plywood (19). These members will now be described in detail with reference to FIG. 4.

A first top plate member (26) should be secured atop the wall (17) and adjacent to the exterior edge of the wall studs (18). A purlin clip (29) may be positioned between each stud (18) and top plate (26) juncture to increase the strength of each such juncture. The purlin clip may then be secured in place by nails or by other fastening agents well known in the art. A second top plate member (27) may then be positioned atop the first top plate (26) and appropriately fastened thereto.

A ceiling joist member (24) having a notch (32) formed on its end may then be disposed at least partially about the two top plate members (26 and 27). Preferably, the notch (32) should have a vertical dimension equal to the vertical height of the two top plate members (26 and 27) and a horizontal dimension somewhat less than the horizontal width of the upper top plate member (27), such that a rim joist member (28) may be positioned snugly in the space between the ceiling joist member (24) and the exterior plywood sheeting (19).

These various members comprising the ceiling-to-wall juncture (23) may then be fastened into position by the use of nails or the like. Importantly, each ceiling joist member (24) should be positioned to rest at least partially upon a wall stud (18) to accommodate the vertical and horizontal forces exerted by the sheltering earth.

It should also be noted that the exterior plywood sheeting (19) overlaps both the two top plate members (26 and 27) and the rim joist member (28), and therefore provides additional sheer strength for the ceiling-to-wall juncture (25).

It may now be appreciated that the ceiling-to-wall juncture (23) forms a strong interlocking unit that strongly resists the weight of the sheltering earth. This notched arrangement causes the wood to accept much of the weight imposed upon the structure, and no one juncture is guarded only by the sheer strength of a fastening agent. Because of this arrangement, the structure will more effectively resist nonalignment, slipping and sagging under the weight of the sheltering material.

Referring to FIGS. 2 and 1, it may be appreciated that exterior walls (43) positioned parallel to the ceiling joist members (24) have a ceiling joist member (24) attached to their interior side adjacent their upper edge. For greatest strength, the ceiling joist member (24) should be secured to the wall (43) at each stud juncture. This orientation imparts great rigidity and strength to the structure, and further assists the structure in withstanding the weight of the sheltering earth.

With continued reference to FIG. 1, the applicant suggests that blocking (33) be provided between both the ceiling joists (24) and floor joists (34) at locations proximal the walls (17) to assist in maintaining the structural integrity of the building. In general, such blocking members (33) should be provided for the first four feet away from the wall (43) or less as may be appropriate.

Sheer walls (36) may also be used internal the structure to assist in strengthening the structure. In particular, blocking (not shown) may be provided approximately half-way up each interior wall (36), and structural plywood may be secured along each interior wall (36). Plasterboard or the like may then be placed over the plywood for a more traditional interior appearance.

The structure may then be otherwise completed in accordance with usual construction standards, with the obvious exception that the roof (37) need not be finished in the usual manner. Rather, the roof (37) may be coated with a layer of bentonize mastic or some similar substance to provide waterproofing and insulation.

A layer of earth (38) may then be placed atop and around the structure to provide the earth sheltering. At least eight inches of earth should be used to obtain important insulating properties, and this amount should be increased to twelve inches to support vegetation. Finally, to enhance drainage, the earth may be leveled such that it begins eighteen inches thick near the south wall (39) and tapers back to twelve inches thick at the rear (41).

To further ensure good drainage, rock and gravel may be disposed about the walls (43) of the structure while backfilling the sheltering earth into place. In particular, coarse crushed rock (44) may extend from the bottom of the foundation wall to a few feet thereabove, and a less coarse gravel (46) may then be used the rest of the way up the wall (43).

Since twelve inches of earth will generally provide only an insulating R value of from about 5 to 8, fiberglass insulation (42) should be provided in the ceiling area and in the walls. Although the earth (38) covering such a structure does not have a high insulation value per se, its primary benefit in winter is its action as an air barrier. In the summertime, the earth sheltering the structure remains cool, and therefore maintains the structure within at a comfortable level.

It should be noted that the air space between the gravel and the floor may be used as a plenum chamber to thereby eliminate the need for costly ductwork for the structure's air circulation system. Such plenum chambers are well-known in the prior art, but are particularly well suited for use in an earth-sheltered structure as described. Heat from sunlight entering through the south facing windows may be stored in the gravel during winter for heating purposes at night, and during the summer, air may be cooled by passing it over the gravel.

A structure properly built in accordance with the invention will adequately support the sheltering layer of earth (38). Furthermore, the unique ceiling-to-wall juncture (23), cooperating at least in part with the other above-mentioned construction techniques, will maintain the structure without significant slippage or shifting.

By practicing the invention herein, an earth-sheltered structure may be built that exceeds necessary structural requirements, and that is both relatively inexpensive and quick to construct. Being comprised substantially of wood, the foundation walls, walls, and ceiling units can of course be pre-fabricated off-site and thereby obtain the benefit of all-weather production quality control and speedy on-site erection.

Obviously, many changes could be made to the invention herein that would be obvious to one skilled in the art, and such improvements are not to be considered as outside the scope of the claims appended hereto.

I claim:

1. In an earth-sheltered structure:

(a) a wall including a plurality of vertically exposed studs;

(b) one or more top plate members disposed and affixed atop the wall and supported by the studs; and (c) a plurality of parallel ceiling joist members having notches formed therein for at least partial disposition about the top plate members and each being directly supported above a stud, and a rim joist member disposed atop said top plate member and being connected to said ceiling joist members.

2. The improvement of claim 1, wherein gravel serves as a foundation footing for said foundation wall.

3. The improvement of claim 1 wherein concrete serves as a foundation footing for said foundation wall.

4. The improvement of claim 1 wherein said wood is treated with chromated copper arsenate to resist environmental forces normally destructive to wood.

5. The improvement of claim 1 wherein said structure is comprised of structural supporting members that are all made substantially of wood.

6. The improvement of claim 1 and further including a plurality of purlin clips, each purlin clip being disposed between a stud and at least one of said top plate members.

7. In an earth-sheltered structure:

a wall including a plurality of vertically disposed studs, one or more top plate members disposed and affixed atop the wall and supported by the studs, a plurality of parallel ceiling joist members having notches formed therein for at least partial disposition about the top plate members and each being directly supported above a stud, and a rim joist member disposed atop said top plate members and being connected to said ceiling joist members, said ceiling joist members including at least a pair of spaced ceiling joist members having a given height of which one ceiling joist member is affixed to a side of said wall to impart strength thereto, and a blocking member disposed between said joists and having a height at least equal to said joist height.

8. The earth-sheltered structure of claim 1 including a wooden floor, a layer of gravel or crushed rock spaced beneath the wooden floor and defining with the wooden floor an air-circulation plenum chamber.

9. In an earth-sheltered structure, a wall including a plurality of vertically disposed studs, one or more top plate members disposed and affixed atop the wall and supported by the studs, a plurality of parallel ceiling joist members having notches formed therein for at least partial disposition about the top plate members and each being directly supported above a stud, a rim joist member disposed atop said top plate members and being connected to said ceiling joist members, said plurality of parallel ceiling joist members including at least a pair of spaced ceiling joist members of which one is affixed to a side of said wall to impart strength thereto, and a blocking member disposed between said joists and having a height at least equal to said joist height, a wooden floor disposed between said walls, a layer of gravel or crushed rock spaced beneath the wooden floor to define with the wooden floor an air-circulation plenum chamber.

10. The improvement of claim 11 wherein said blocking members are disposed between parallel ceiling joists for a distance of at least four feet from the walls parallel to the ceiling joists.

11. In an earth-sheltered structure having a roof at least substantially covered by earth, an improved ceiling-to-wall juncture including a wall comprising a plurality of vertically disposed studs, and a plurality of spaced, substantially parallel ceiling joist members parallel to the wall and including at least a pair of spaced ceiling joist members having a given height and of which one is affixed to a side of said wall to impart strength thereto, and a blocking member disposed between said pair of joists and having a height at least equal to the given height of said joists.

* * * * *